US006453988B1

(12) United States Patent
Nakado et al.

(10) Patent No.: US 6,453,988 B1
(45) Date of Patent: Sep. 24, 2002

(54) HEAT EXCHANGER AND DIMPLE TUBE USED IN THE SAME, THE TUBE HAVING LARGER OPPOSED PROTRUSIONS CLOSEST TO EACH END OF TUBE

(75) Inventors: Koji Nakado; Masashi Inoue, both of Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/628,644

(22) Filed: Jul. 28, 2000

(30) Foreign Application Priority Data

Jul. 28, 1999 (JP) ..... 11-214385

(51) Int. Cl.[7] ..... F28F 1/06

(52) U.S. Cl. ..... 165/152; 165/177; 165/173; 165/153

(58) Field of Search ..... 165/177, 173, 165/152, 153; 29/727

(56) References Cited

U.S. PATENT DOCUMENTS 5,101,887 A * 4/1992 Kado ..... 165/76
5,450,997 A * 9/1995 Turak et al. ..... 228/183
5,620,047 A * 4/1997 Nishishita ..... 165/153
5,632,331 A * 5/1997 Shinmura ..... 165/153
5,855,240 A * 1/1999 Farrell et al. ..... 165/76
6,073,688 A * 6/2000 Kato ..... 165/177
6,269,868 B1 * 8/2001 Welding et al. ..... 165/149

* cited by examiner

*Primary Examiner*—Allen Flanigan

(57) ABSTRACT

A heat exchanger employing a dimple tube in which sufficient strength is provided by improving the processing accuracy of the dimple tube and decreasing the processing error. The tube includes a plate folded in two so as to make two edges of the plate contact each other and form a flat tube. The plate comprises protrusions provided on each inner wall of the flat tube in a manner such that the heads of opposed protrusions on both the inner walls contact each other. The plate is clad with a brazing filler metal and the protrusions are formed on a surface of the plate before the plate is folded, and the two edges of the plate and the heads of the opposed protrusions are respectively brazed after the plate is folded. A predetermined number of sets of the opposed protrusions, positioned closest to the end of the tube, are larger than the other protrusions in a manner such that their size along the longitudinal direction of the tube is larger.

9 Claims, 6 Drawing Sheets

HEAT EXCHANGER AND DIMPLE TUBE USED IN THE SAME, THE TUBE HAVING LARGER OPPOSED PROTRUSIONS CLOSEST TO EACH END OF TUBE

BACKGROUND OF THE INVENTION

1. Field of the Invention

The present invention relates to a heat exchanger and a tube used in the same, provided in an air conditioner of a vehicle, or the like.

2. Description of the Related Art

Recently, tubes such as that shown in FIG. 7 have gradually come to be used in heat exchangers provided in air conditioners of vehicles, as a substitute for known extrusion-molded tubes. This tube shown in FIG. 7 is made by folding a plate in two so as to form a flat shape, and brazing the side edges of the plate together so as to form tube portion 1. A feature of this tube is the presence of dimples 3 formed from the outside of each of the opposed walls 2*a* and 2*b*, where the dimples protrude inside and two corresponding dimples from either wall side adhere to each other so that a plurality of column portions 4 are formed. Due to the column portions 4, turbulence of refrigerant occurs, thereby improving the heat-exchanging capability.

Due to the presence of the so-called "dimple" tube, the thickness of the tube wall can be thin because the tube portion is formed by folding a plate; thus, little material is necessary for manufacturing and the manufacturing cost is thus low, and as described above, a good heat-exchanging capability can be obtained because of the thin walls. In addition, the column portions 4 made of the dimples 3 are regularly arranged along the longitudinal direction of the tube, so that sufficient compressive strength (or pressure tightness) can be obtained even with the thin tube walls.

FIG. 8 shows a sectional view of a heat exchanger employing the dimple tube. In the figure, reference numerals 5 indicate dimple tubes, reference numeral 6 indicates a header having a hollow-cylindrical shape, and reference numerals 7 indicate cooling fins. An end of each dimple tube 5 is inserted inside the header 6 via tube insertion opening 6*a*. The inserted portion is fixed by brazing. The reason for using a hollow-cylindrical member (e.g., a pipe) as the header 6 is to secure the necessary compressive strength.

As explained above, the dimple tube is made by folding a plate in two and brazing the parts as necessary. The actual manufacturing of a heat exchanger does not employ a process in which the brazed dimple tube is inserted into the header and the inserted portion is again brazed so as to combine them. In the actual manufacturing process, a plate clad with a brazing filler metal is folded in two and inserted into the header, and after other portions such as cooling fins are also assembled, the assembled body is put into a heating furnace so as to braze each relevant portion.

Here, in the folded plate, the elastic force (or the like) of the plate may prevent the protruding portions of two dimples from adhering to each other. In order to solve this problem, the (shape of the) cooling fins is used, where the cooling fins and the tube plates are alternately arranged when they are attached to the header. Here, the elastic force of the cooling fins, between which the tube plates are placed, is used so as to make the corresponding protrusions of the dimples closely contact each other.

However, in the vicinity of the end of the dimple tube which is inserted into the header, the pressing force from the cooling fins may be insufficient. Accordingly, the corresponding protrusions do not closely contact each other and thus the brazing is incomplete, so that the necessary strength may not be obtained.

SUMMARY OF THE INVENTION

In consideration of the above circumstances, an objective of the present invention is to provide sufficient strength to a heat exchanger employing a dimple tube by improving the processing accuracy of the dimple tube and decreasing the processing error.

Therefore, the present invention provides a tube used in a heat exchanger, comprising a plate folded in two so as to make two edges of the plate contact each other and form a flat tube, wherein:

the plate comprises protrusions provided on each inner wall of the flat tube in a manner such that the heads of opposed protrusions on both the inner walls contact each other;

the plate is clad with a brazing filler metal and the protrusions are formed on a surface of the plate before the plate is folded, and the two edges of the plate and the heads of the opposed protrusions are respectively brazed after the plate is folded; and a predetermined number of first sets of the opposed protrusions, positioned closest to the end of the tube, are larger than the other protrusions in a manner such that their size along the longitudinal direction of the tube is larger.

In the manufacturing of the heat exchanger, the force for making (i) the two edges of the plate and (ii) the heads of the opposed protrusions can be obtained by cooling fins, where the tubes and the cooling fins are alternately arranged with each other. According to the above structure in which the first sets of the opposed protrusions, positioned closest to the end of the tube, are larger than the other protrusions, the rigidity of the relevant end of the plate is improved, so that the pushing force from the cooling fins is transmitted from the middle area of the tube to the vicinity of the end portion of the tube, where the middle area receives sufficient pushing force from the cooling fins while the vicinity of the end portion originally receives less pushing force. Accordingly, the first sets of the opposed protrusions can closely contact each other. Therefore, the brazing filler metal spreads all over the heads of the opposed protrusions in the heating process and the heads are firmly brazed, thereby improving the joint strength.

Preferably, the width of each protrusion belonging to the first sets in a cross direction of the tube is substantially the same as the corresponding width of each of the other protrusions. Accordingly, the cross section of the passage in the area where the first sets of the protrusions are provided is substantially the same as the corresponding cross section of the passage in the area where the other protrusion are provided, so that an increase of pressure loss can be prevented at the relevant end of tube.

The present invention also provides a heat exchanger comprising:

a pair of headers, each having a plurality of tube insertion openings;

a plurality of tubes attached to the headers and arranged in parallel to each other, where both ends of each tube are inserted into the relevant tube insertion openings of the headers; and cooling fins provided between the tubes arranged in parallel, and wherein:

each tube comprises a plate folded in two so as to make two edges of the plate contact each other and form a flat tube, wherein:

the plate comprises protrusions provided on each inner wall of the flat tube in a manner such that the heads of opposed protrusions on both the inner walls contact each other; and the plate is clad with a brazing filler metal and the protrusions are formed on a surface of the plate before the plate is folded, and the two edges of the plate and the heads of the opposed protrusions are respectively made to contact by folding the plate, and wherein:

the assembled headers, tubes, and cooling fins are heated, and the two edges of the plate, the heads of the opposed protrusions, contact portions between the two ends of each tube and the headers, and contact portions between each tube and the cooling fins are respectively brazed; and the cooling fins are arranged in a manner such that a predetermined number of first sets of the opposed protrusions which are positioned closest to the end of the tube directly receive a pushing force from the cooling fins.

Preferably, the first sets of the opposed protrusions are larger than the other protrusions in a manner such that their size along the longitudinal direction of the tube is larger.

In the above structure, the cooling fins are arranged between the tubes in a manner such that a predetermined number of first sets of the opposed protrusions which are positioned closest to the end of the tube directly receive the pushing force of the cooling fins; thus, the brazing filler metal spreads all over the heads of the opposed protrusions in the heating process and the heads are firmly brazed, thereby improving the joint strength.

According to the present invention, the joint strength of the folded plate portions is improved, thereby improving the compressive strength (or pressure tightness) at the relevant end of the tube.

DESCRIPTION OF THE PREFERRED EMBODIMENTS

Hereinafter, an embodiment of a heat exchanger and a tube used in the same according to the present invention will be explained in detail with reference to FIGS. 1 to 6.

Figure 1:
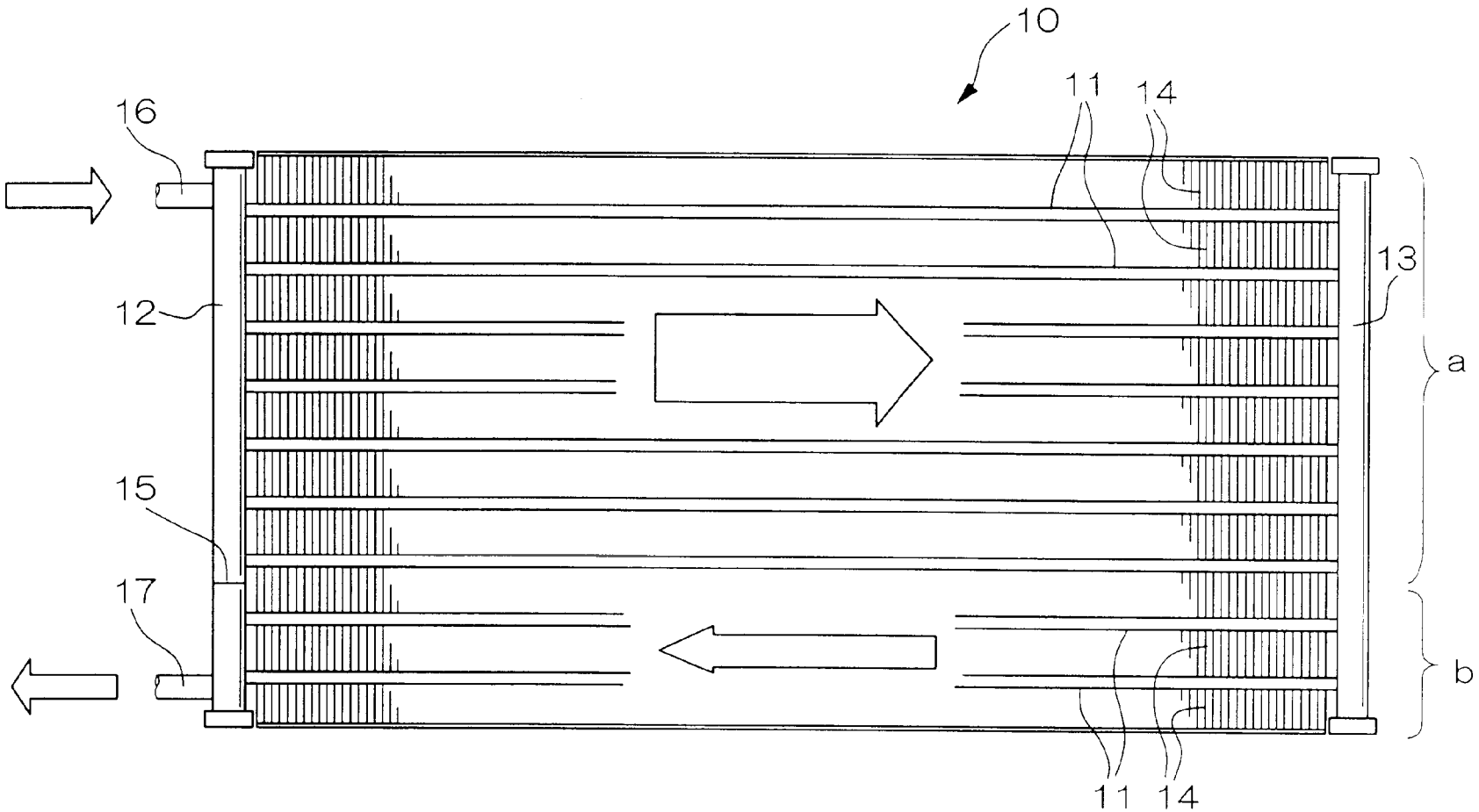
FIG. 1 is a front view showing an embodiment of the heat exchanger according to the present invention.

FIG. 1 shows a parallel-flow type heat exchanger 10 comprising flat tubes 11, 11, . . . arranged in parallel with each other in a non-contact state (that is, each tube 11 is apart from the others in the vertical direction in FIG. 1), a pair of headers 12 and 13 into which both ends of each tube 11 are respectively inserted, where the headers 12 and 13 join with the refrigerant path in each tube 11. The heat exchanger also comprises wave-shaped cooling fins 14, 14, . . . , each provided between adjacent tubes 11.

The inside of header 12 is divided into two sections by a partition (plate) 15 which is positioned at a little lower than the center portion. A pipe 16 for introducing refrigerant is attached to the upper section of header 12, the pipe joining with the inside of the upper section of header 12. On the other hand, a pipe 17 for discharging refrigerant is attached to the lower section of header 12, the pipe joining with the inside of the lower section of header 12. Accordingly, as shown by the arrows in FIG. 1, the refrigerant flows through each tube 11 (i) from header 12 to header 13 in the area "a" (i.e., the upper area from the partition 15), or (ii) from header 13 to header 12 in the area "b" (i.e., the lower area from the partition 15).

Figure 2:
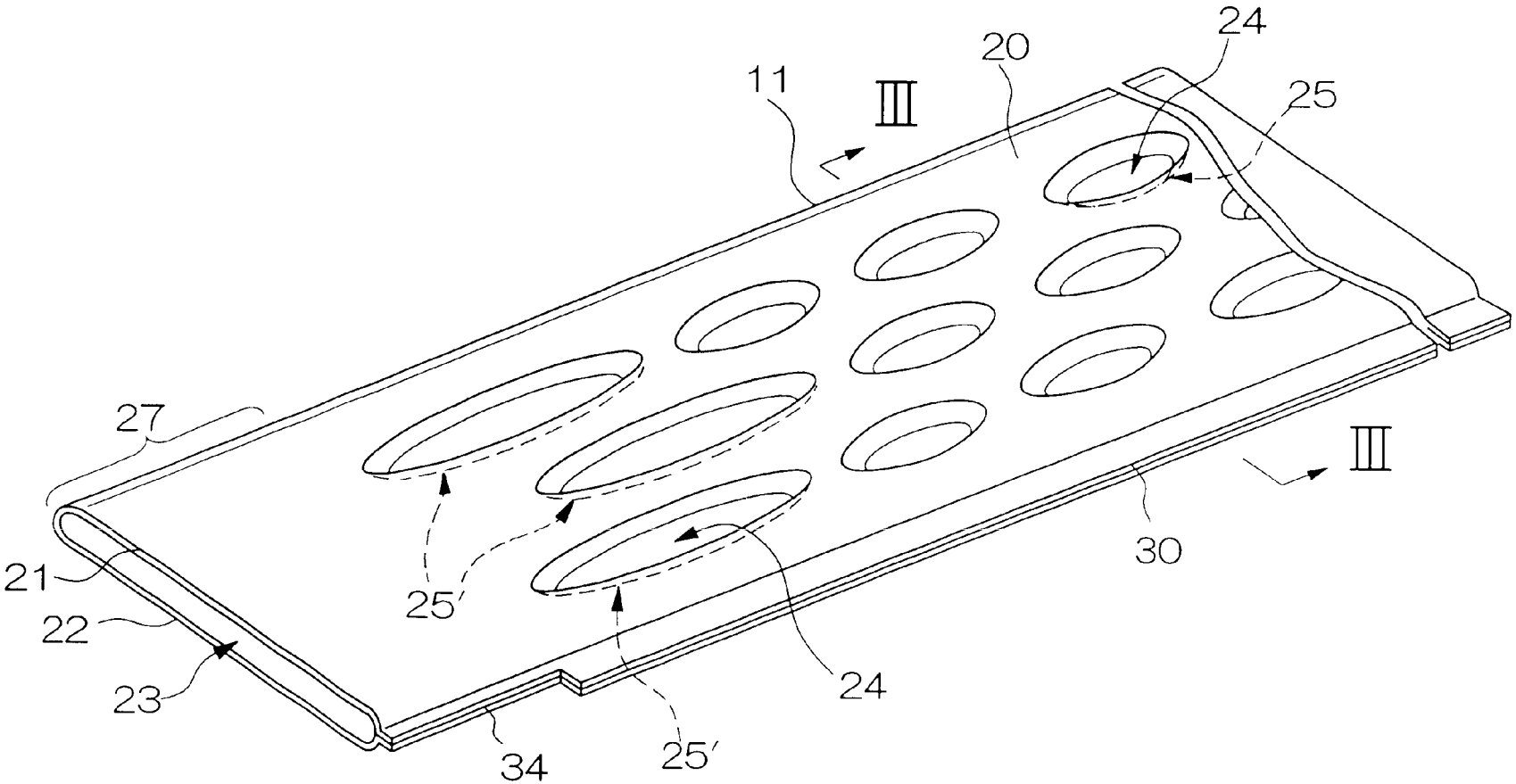
FIG. 2 is a perspective view of a tube used in the heat exchanger in FIG. 1.

As shown in FIG. 2, the tube 11 has a tube shape formed by folding plate 20 flat in two and brazing the folded two edges. The tube 11 has first wall 21 and second wall 22 which are substantially parallel to each other in a non-contact state, and a refrigerant path 23 is formed in the space surrounded by the first and second walls.

A plurality of dimples 24 are formed by protruding relevant portions from the outside of each of the opposed first and second walls 21 and 22; thus, a plurality of protrusions 25 corresponding to the dimples 24 are formed at the refrigerant path 23 side.

Figure 3:
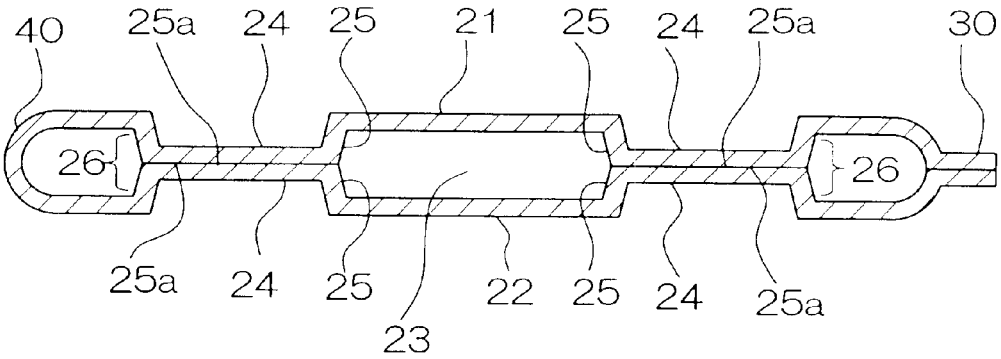
FIG. 3 is a cross-sectional view along line III—III in FIG. 2.

In a plan view, each protrusion has an elliptic shape, the major axis of the ellipse being along the longitudinal direction of tube 11. As shown in FIG. 3, the heads 25*a* of the opposed protrusions are made to contact each other so that column portions 26 are formed between the first and second walls 21 and 22, and each has an elliptic cross-sectional shape. Here, the cross-sectional shape of the column portions 26 is not limited to an ellipse, but circles, ovals, or the like are also possible.

Figure 4:
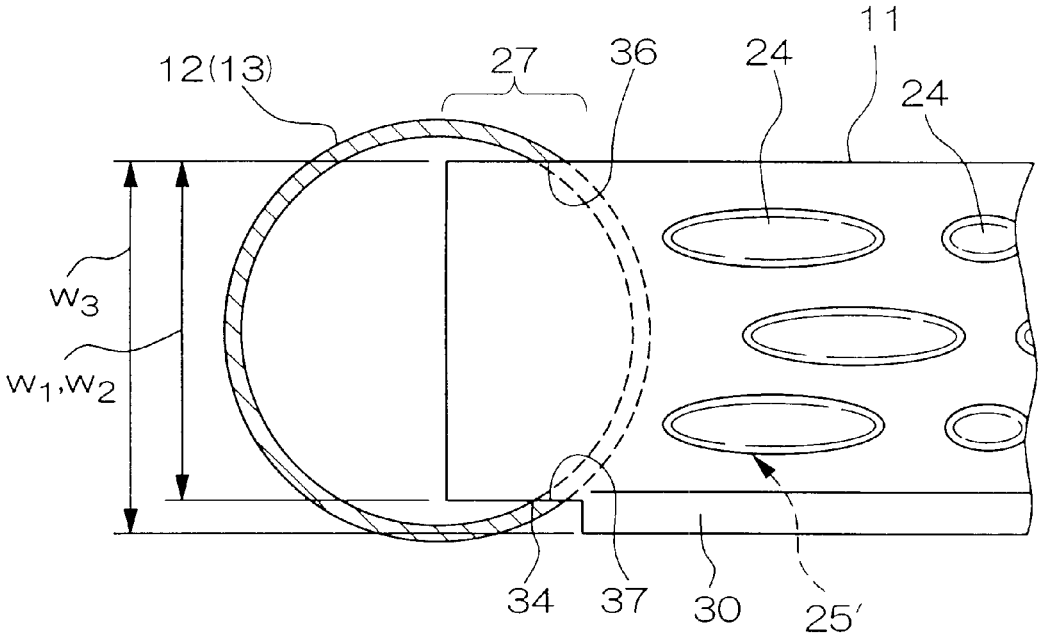
FIG. 4 is a horizontal sectional view showing the joint portion of the header and the tube.

As shown in FIGS. 2 and 4, the protrusions 25 are arranged in an inclined checker pattern along the longitudinal direction of tube 11, where the longitudinal spans of any two adjacent protrusions on each inclined line (of the checker pattern), that is, the ranges corresponding to both spans in the longitudinal axis of the tube partially overlap each other. The column portions 26 have a similar arrangement. In addition, no column portion 26 is formed in the ends of the tube 11, inserted into the header 12 (or 13), that is, the wall of tube end 27 in FIG. 4 has no convex or concave portion.

As shown in FIGS. 2 and 4, a brazed edge (or seam portion, explained later) 30 is provided at one side edge of tube 11. As explained above, the ends of the tube 11 are inserted into headers 12 and 13, where each end has an indent (i.e., indented portion) 34 formed by removing a portion of brazed edge 30. On the other hand, in each header, a plurality of tube insertion openings 36 corresponding to the shape of the tube 11 are provided for inserting tubes 11 into the headers. Each tube insertion opening 36 has a groove 37 for inserting and fitting the brazed edge 30, a portion of which is intended as explained above.

The width w1 of the tube insertion opening 36 is approximately the same as width w2 of tube 11 including the indent 34 portion, and width w2 of tube 11 including brazed edge 30 is larger than width w1 of the tube insertion opening 36. Accordingly, when the relevant end of tube 11 is inserted into the tube insertion opening 36, the step of the brazed edge 30, provided at the end of indent 34, hits against the header 12 and further insertion of the tube is prevented.

Below, the process of manufacturing the heat exchanger 10 having the above-explained structure will be explained with reference to FIGS. 5A to 5D.

Figure 5B:
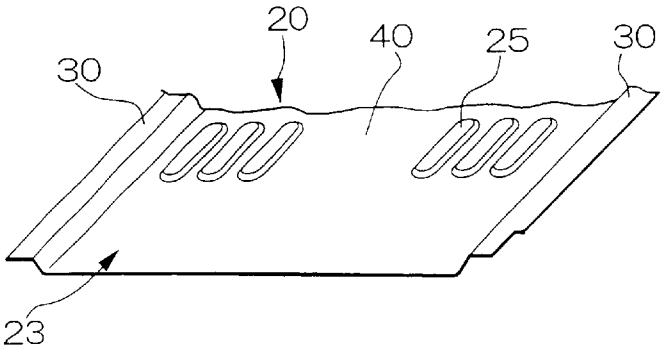
FIGS. 5A to 5D are diagrams explaining the processes for manufacturing the heat exchanger of FIG. 1.
Figure 5D:
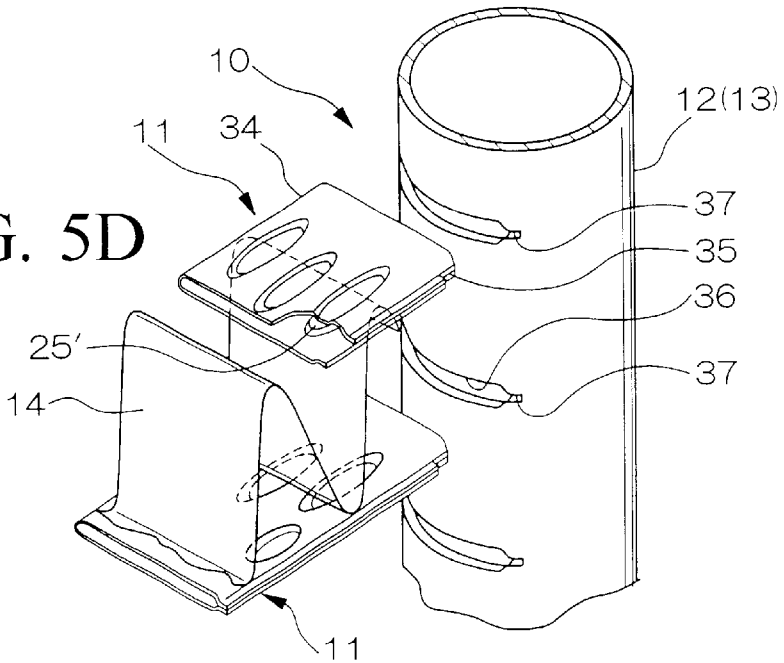
Figure 5A:
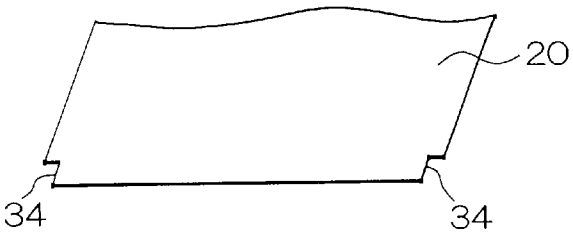

First, as shown in FIG. 5A, plate 20 for making tube 11 is prepared and both sides functioning as the inner and outer faces of tube 11 are clad with a brazing filler metal, and indents 34 are formed at relevant edges of plate 20. Here, indents 34 may be formed after the plate is folded in two.

Figure 5C:
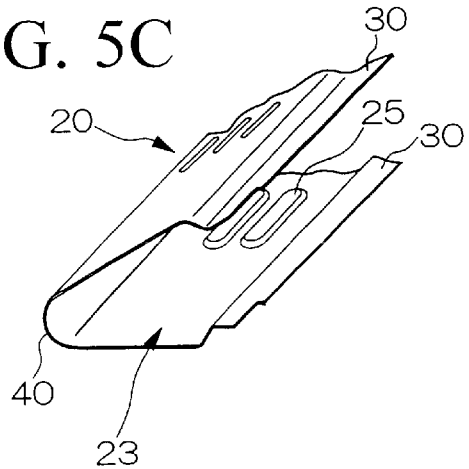

Next, as shown in FIG. 5B, the plate 20 is press-molded or roll-molded so that protrusions 25 are formed in an area corresponding to refrigerant path 23. In addition, folded portion 40 (i.e., target portion to be folded) is provided, and brazed edges 30, 30 are formed at the both sides. In the next step, as shown in FIG. 5C, the plate 20 is folded along the folded portion 40. In the folded plate 20, the brazed edges 30, 30 are made to contact each other, and the heads 25*a* of corresponding protrusions 25 are also made contact each other, so that a flat tube 11 is formed.

Next, as shown in FIG. 5D, headers 12 and 13 having tube insertion openings 36 are prepared. The relevant end (i.e., the above tube end 27) of each tube 11 is inserted into a target tube insertion opening 36, and cooling fins 14 are provided between the adjacent tubes 11, so that the body of the heat exchanger 10 is assembled. The assembled heat exchanger 10 is put into a heating furnace (not shown) and is heated at a specific temperature for a predetermined time, so that the brazing filler metal (with which the plate 20 is clad) dissolves so that target contact portions of heat exchanger 10, between (i) brazed edges 30, 30, (ii) heads 25*a*, 25*a* of the protrusions 25, (iii) each end of tube 11 and corresponding tube insertion openings 36, and (iv) tube 11 and cooling fins 14 (which contact the tube), are respectively brazed, and the heat exchanger 10 is completed.

Figure 6:
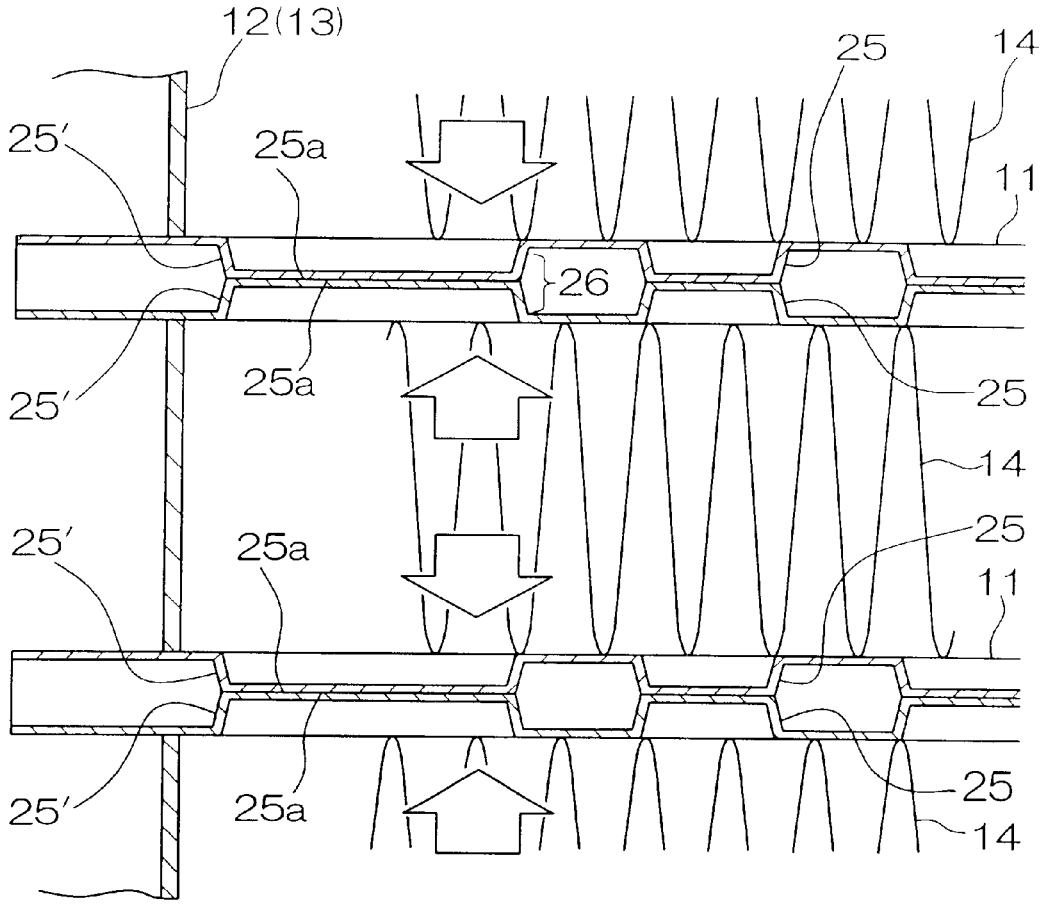
FIG. 6 is a vertical sectional view showing each joint portion of the header and the tubes.
Figure 7:
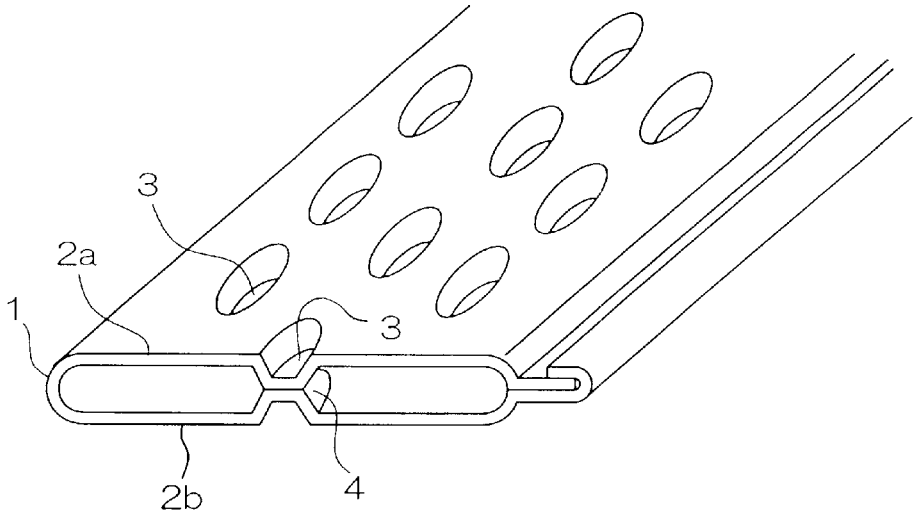
FIG. 7 is a perspective view showing an example of the dimple tube.
Figure 8:
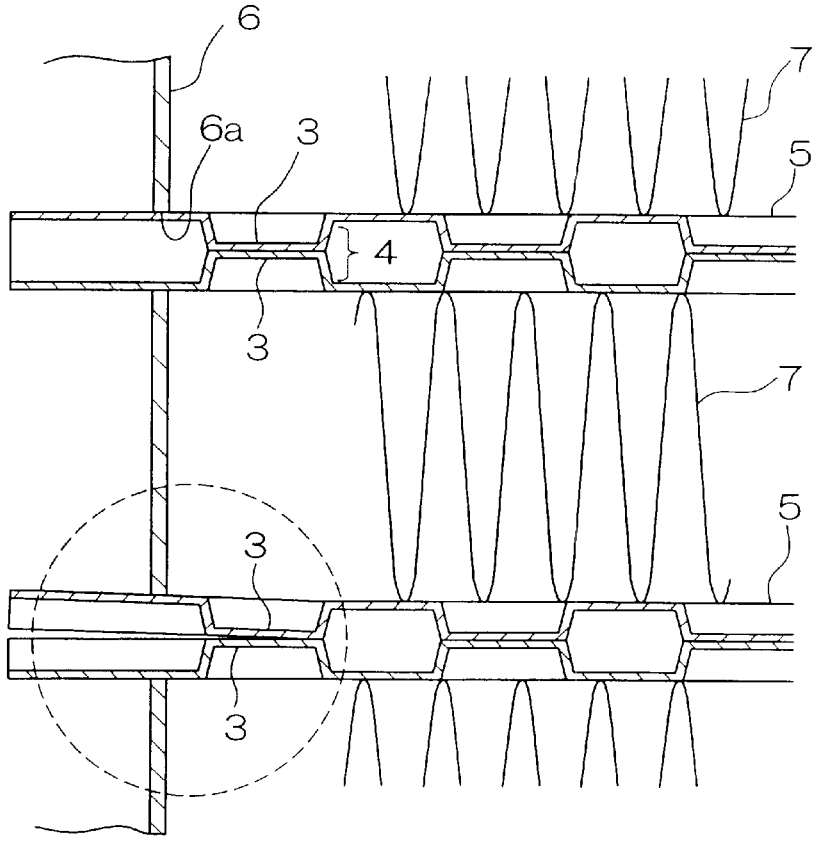
FIG. 8 is a vertical sectional view showing each joint portion of the header and the dimple tubes in a conventional heat exchanger.

In the above heat exchanger, as shown in FIGS. 2 and 6, three protrusions 25' which are closest to the end of the tube 11 (i.e., the first sets of protrusions according to the present invention) are larger then the other protrusions 25, where each protrusion 25' has a shape obtained by enlarging or stretching the major axis of the ellipse of the original protrusion 25. In addition, the cooling fins 14 are inserted between the tubes 11,11 in a manner such that the range in the longitudinal direction of the tube 11 where the cooling fins 14 are provided (from the dimple 24 side) not only includes each protrusion 25 area but also reaches each protrusion 25' area as shown in FIG. 6.

In the processes of manufacturing the heat exchanger, the force used for making (i) brazed portions 30, 30 and (ii) heads 25*a*, 25*a* (of protrusions 25) closely contact each other is obtained by the cooling fins 14 inserted between the tubes 11, 11. Here, the protrusions 25' are larger as described above; thus, the rigidity of the relevant end of plate 20 of tube 11 is improved. Therefore, the pushing force from the cooling fins 14 (acting in the directions shown by the arrows in FIG. 6) is transmitted from the middle area of the tube 11 to the vicinity of the end portion of tube 11, where the middle area receives sufficient pushing force from the cooling fins 14 while the vicinity of the end portion originally receives less pushing force. Accordingly, the opposed protrusions 25' can closely contact each other.

In addition, as explained above, the area where the cooling fins 14 are arranged partially overlaps the area where the protrusions 25' are formed. Therefore, the protrusions 25' can directly receive the pushing force from the cooling fins 14; thus, the opposed protrusions 25' can be much more strongly pushed against each other and can reliably contact each other.

When the assembly including such sufficiently contacting elements is heated, the brazing filler metal between the facing protrusions 25', 25' spreads all over each head 25*a*. Therefore, in the completed heat exchanger, the adhesion strength between the first and second walls 21 and 22 is improved, thereby improving the compressive strength (or pressure tightness) at the relevant end of tube 11.

In addition, as explained above, the shape of each protrusion 25' is obtained by enlarging or stretching the major axis of the ellipse of the original protrusion 25 in the longitudinal direction of tube 11. Therefore, the width of protrusion 25' is substantially the same as the corresponding width of protrusion 25, and thus in tube 11, the cross section of the passage in the protrusion 25' area is substantially the same as the corresponding cross section of the passage in the protrusion 25 area, so that an increase of pressure loss can be prevented at the relevant end of tube 11.

As explained above, in the present embodiment, three protrusions 25' closer to each header (12 or 13) are larger than the other protrusions 25. However, the number of the larger protrusions can be suitably determined according to the shape of tube 11, in other words, to the arrangement of the dimples.

What is claimed is:

1. A tube used in a heat exchanger, comprising:

a plate folded in two so as to make two edges of the plate contact each other and form a flat tube, wherein:

the plate comprises protrusions provided on each inner wall of the flat tube in a manner such that the heads of opposed protrusions on both the inner walls contact each other;

the plate is clad with a brazing filler metal and the protrusions formed on a surface of the plate before the plate is folded, and the two edges of the plate and the heads of the opposed protrusions are respectively brazed after the plate is folded;

the tube is placed between a pair of headers of a heat exchanger, which are provided for circulating refrigerant, and the tube has two ends which are respectively inserted into the pair of headers;

a predetermined number which is at least two of first sets of the opposed protrusions, positioned closest to each end of the tube, are larger than the other protrusions in a manner such that their size along the longitudinal direction of the tube is larger, so as to improve rigidity.

2. A tube as claimed in claim 1, wherein the width of each protrusion belonging to the first sets in a cross direction of the tube is substantially the same as the corresponding width of each of the other protrusions.

3. A heat exchanger comprising:

a pair of headers provided for circulating refrigerant, each having a plurality of tube insertion openings;

a plurality of tubes placed between the pair of headers and arranged in parallel to each other in a vertical direction, where each tube has two ends which are respectively inserted into the relevant tube insertion openings of the headers; and cooling fins provided between the tubes arranged in parallel, and wherein:

each tube comprises a plate folded in two so as to make two edges of the plate contact each other and form a flat tube, wherein:

the plate comprises protrusions provided on each inner wall of the flat tube in a manner such that the heads of opposed protrusions on both the inner walls contact each other; and the plate is clad with a brazing filler metal and the protrusions are formed on a surface of the plate before the plate is folded, and the two edges of the plate and the heads of the opposed protrusions are respectively made to contact by folding the plate, and wherein:

the assembled headers, tubes, and cooling fins are heated, and the two edges of the plate, the heads of the opposed protrusions, contact portions between the two ends of each tube and the headers, and contact portion between each tube and the cooling fins are respectively brazed; and the cooling fins are arranged in a manner such that a predetermined number which is at least two of first sets of the opposed protrusions which are positioned closest to each end of each tube directly receive a pushing force from the cooling fins.

4. A heat exchanger as claimed in claim 3, wherein the first sets of the opposed protrusions are larger than the other protrusions in a manner such that their size along the longitudinal direction of the tube is larger, so as to improve rigidity.

5. A tube as claimed in claim 1, wherein the heads of the protrusions have an inner and outer surface which are continuous and uninterrupted.

6. A tube as claimed in claim 1, wherein between the predetermined number of first sets and the end of the tube is free of protrusions.

7. The heat exchanger according to claim 3, wherein the heads of the protrusions have an inner and outer surface which are continuous and uninterrupted.

8. The heat exchanger according to claim 3, wherein between the predetermined number of first sets and the end of the tube is free of protrusions.

9. The heat exchanger according to claim 3, wherein the headers are arranged in a vertical direction which is parallel to the vertical direction of the plurality of tubes.

* * * * *